US009260670B2

(12) United States Patent
Grenoble et al.

(10) Patent No.: US 9,260,670 B2
(45) Date of Patent: Feb. 16, 2016

(54) PROCESS FOR THE SELECTIVE HYDROGENATION AND HYDRODESULFERIZATION OF A PYROLYSIS GASOLINE FEEDSTOCK

(75) Inventors: Dane Clark Grenoble, Houston, TX (US); Paul Benjerman Himelfarb, Leipzig (DE); Michael Norris Treybig, Houston, TX (US); Brian Scott Vanderwilp, Katy, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/376,531

(22) PCT Filed: Jun. 9, 2010

(86) PCT No.: PCT/US2010/037864

§ 371 (c)(1),
(2), (4) Date: Jan. 16, 2012

(87) PCT Pub. No.: WO2010/144512

PCT Pub. Date: Dec. 16, 2010

(65) Prior Publication Data

US 2012/0108866 A1 May 3, 2012

Related U.S. Application Data

(60) Provisional application No. 61/186,035, filed on Jun. 11, 2009.

(51) Int. Cl.
*C07C 7/163* (2006.01)
*C10G 45/32* (2006.01)
(Continued)

(52) U.S. Cl.
CPC ..... *C10G 45/32* (2013.01); *C10G 45/02* (2013.01); *C10G 69/06* (2013.01); *C10G 2300/104* (2013.01); *C10G 2300/1044* (2013.01); *C10G 2300/202* (2013.01);
(Continued)

(58) Field of Classification Search
USPC ..... 585/259, 260, 261, 262; 208/142, 143, 208/144, 145, 57, 58, 59, 68, 255
See application file for complete search history.

(56) References Cited

U.S. PATENT DOCUMENTS 2,916,434 A 12/1959 Draeger et al. ..... 208/66
3,024,188 A 3/1962 Yei et al. ..... 208/264
(Continued)

FOREIGN PATENT DOCUMENTS

AU 492574 10/1975
EP 1277826 1/2003 ..... C10G 45/34
(Continued)

*Primary Examiner* — In Suk Bullock
*Assistant Examiner* — Sharon Pregler

(57) ABSTRACT

Disclosed is a process for the selective hydrogenation of diolefins and sulfur compounds that are contained in a pyrolysis gasoline feedstream. The process includes utilizing a single hydrotreating reaction stage by introducing the pyrolysis gasoline feedstock that includes a diolefin concentration and an organic sulfur concentration into a reactor that is loaded with a high activity hydrotreating catalyst and which is operated under selective hydrogenation conditions. A reactor effluent having a reduced diolefin concentration and a reduced organic sulfur concentration is yielded from the reactor and is separated into a portion that is recycled as a reactor feed. The remaining portion of the reactor effluent is passed downstream for further processing or handling.

14 Claims, 1 Drawing Sheet

(51) Int. Cl.
*C10G 45/02* (2006.01)
*C10G 69/06* (2006.01)

(52) U.S. Cl.
CPC ..... *C10G 2300/4018* (2013.01); *C10G 2300/4081* (2013.01); *C10G 2400/30* (2013.01)

(56) References Cited

U.S. PATENT DOCUMENTS

| | | | | | |
|---|---|---|---|---|---|
| 3,116,233 | A | | 12/1963 | Douwes et al. | 208/143 |
| 3,221,078 | A | | 11/1965 | Keith et al. | 260/683.9 |
| 3,493,492 | A | | 2/1970 | Sze | 208/255 |
| 3,691,066 | A | | 9/1972 | Carruthers et al. | 208/255 |
| 4,059,504 | A | * | 11/1977 | Bauer | 585/260 |
| 4,113,603 | A | | 9/1978 | Bauer | 208/89 |
| 6,235,954 | B1 | | 5/2001 | Wu et al. | |
| 6,388,150 | B1 | | 5/2002 | Overbeek et al. | 585/260 |
| 6,437,206 | B1 | | 8/2002 | Meyer et al. | |
| 6,495,030 | B1 | | 12/2002 | Podrebarac | |
| 6,881,324 | B2 | | 4/2005 | Smith, Jr. | |
| 7,294,604 | B2 | | 11/2007 | Dath et al. | |
| 2003/0225305 | A1 | | 12/2003 | Kaminsky | 585/269 |
| 2005/0006281 | A1 | * | 1/2005 | Boger et al. | 585/250 |
| 2009/0223866 | A1 | | 9/2009 | Bhan | 208/216 |
| 2009/0223867 | A1 | | 9/2009 | Bhan | 208/216 R |
| 2010/0236988 | A1 | | 9/2010 | Gabrielov et al. | 208/217 |

FOREIGN PATENT DOCUMENTS

| | | | |
|---|---|---|---|
| GB | 848232 | 8/1958 | |
| GB | 2022130 | 12/1970 | C10G 23/00 |
| GB | 2131043 | 6/1984 | C10G 65/06 |
| WO | WO2004003111 | 1/2004 | C10G 45/00 |
| WO | WO2009039020 | 3/2009 | C10G 45/02 |

* cited by examiner

PROCESS FOR THE SELECTIVE HYDROGENATION AND HYDRODESULFERIZATION OF A PYROLYSIS GASOLINE FEEDSTOCK

PRIORITY CLAIM

The present application claims priority from PCT/US2010/037864, filed 9 Jun. 2010 which claims priority from U.S. Application 61/186,035 filed 11 Jun. 2009.

This invention relates to a process for the selective hydrogenation of diolefins, olefins and sulfur compounds that are contained in a pyrolysis gasoline feedstock.

Pyrolysis gasoline is obtained as a normally liquid by-product from the high temperature thermal cracking of gaseous hydrocarbons, such as ethane and propane, or liquid hydrocarbons, such as naphtha and gas oil, to make lower olefins, such as ethylene and propylene. Pyrolysis gasoline includes components having boiling temperatures in the gasoline boiling range, and it is highly aromatic and olefinic. Due to the high-octane components contained in pyrolysis gasoline, it sometimes can be used as a high-octane blending component into motor gasoline. More importantly, with its high concentrations of aromatic compounds, a preferred use of pyrolysis gasoline is as a source of aromatics. However, pyrolysis gasoline typically contains undesirable components, such as, for example, diolefins (also referred sometimes herein to as dienes) and sulfur compounds. And, if the pyrolysis gasoline is used as a source of aromatics, which may be recovered by solvent extraction methods, even the presence of monoolefins contained in the pyrolysis gasoline is undesirable and need to be removed from the pyrolysis gasoline along with the diolefins and sulfur prior to the extraction of the aromatics.

The patent literature discloses various processes for the selective hydrogenation of dienes, monoolefins, and sulfur compounds that are contained in pyrolysis gasoline. Typically, the prior art processes include two reaction stages used in the hydrotreating of a pyrolysis gasoline.

Disclosed in U.S. Pat. No. 3,691,066 is a process for the selective hydrogenation of steam cracker gasoline. In this process, a pyrolysis gasoline containing diolefins, mono-olefins, aromatics and sulfur compounds is passed over a supported nickel catalyst under certain specified process conditions to yield a product having reduced diolefin and organic sulfur content. The catalyst contains from 1 to 50 wt % nickel that is predominantly in the elemental nickel form and preferably supported on sepiolite. The '066 patent indicates that its process is selective in the hydrogenation of diolefins over mono-olefins, but the patent does not indicate that its process is particularly selective in the hydrogenation of diolefins or mono-olefins over aromatics. The '066 patent also indicates that the mono-olefins of its hydrogenated product may in a subsequent hydrogenation stage be saturated so that aromatics can be extracted therefrom, thus, indicating that its process does not use a single reaction stage to hydrogenate both diolefins and mono-olefins over aromatics to yield a product from which aromatics may be extracted.

U.S. Pat. No. 4,059,504 discloses a process for the selective hydrotreating of a pyrolysis gasoline using a catalyst of cobalt-tungsten sulfide supported on high surface area alumina. The '504 patent further discloses two different classes of prior art catalysts that are used in the first stage hydrogenation of pyrolysis gasoline hydrotreating processes. The two classes of catalysts are noble metal and non-noble metal. The non-noble metal catalysts include those that are Ni—Mo or Co—Mo metal supported on high surface area alumina. The non-noble metal catalysts are generally less active than noble metal catalysts, and they have the disadvantage of producing polymers during the hydrotreating. Use of the cobalt-tungsten sulfide catalyst in the hydrotreating of pyrolysis gasoline provides for selective hydrogenation of diolefins with a minimization of polymer formation that typically occurs with the use of the prior art non-noble metal catalysts. The '504 patent asserts that the use of its catalyst provides for the conversion of diolefins to mono-olefins while minimizing or eliminating the saturation of mono-olefins and aromatics. There is no suggestion that the process of the '504 patent selectively saturates both diolefins and mono-olefins over aromatics.

U.S. Pat. No. 4,113,603 discloses a two-reactor stage process for the hydrotreating of pyrolysis gasoline containing dienes and mercaptan sulfur. The first stage of the process uses a non-noble metal catalyst and is operated at reasonably mild conditions to provide for desulfurization without an excessive amount of undesirable polymer formation. The second stage uses a noble metal catalyst and is operated under conditions to reduce the diene content of the feed. The non-noble metal hydrotreating catalyst of the first stage can include either nickel alone, tungsten alone, a combination of tungsten and nickel, or a combination of nickel and/or tungsten, with cobalt and/or molybdenum. It is notable that the process of the '603 patent requires two reaction stages to perform both the diene hydrogenation and desulfurization of sulfur compounds and requires the use of a noble metal catalyst for the diene hydrogenation.

GB 2,131,043 teaches a two-reactor stage process for the selective hydrogenation of dienes contained in a pyrolysis gasoline feed. The process is to both hydrogenate the dienes of the pyrolysis gasoline feed to their corresponding monoolefins and avoid the formation of polymers and gums that deposit on the catalyst and cause increased pressure drop. In order to achieve these benefits, the first stage uses a supported catalyst having a low Group 8 metal content and the second stage uses a supported catalyst having a high Group 8 metal content. The first stage catalyst contains from 1 to 5 wt % of a Group 8 metal and the second stage catalyst contains from 5 to 40 wt % of a Group 8 metal.

There are ongoing efforts to provide improved processes for the hydrotreating of the pyrolysis gasoline product of thermal crackers to provide a treated product that may suitably be used, for example, as a gasoline blending component or further processed to extract aromatics therefrom. Typically, the prior art processes use two reactor stages to hydrogenate dienes and to remove sulfur compounds from the pyrolysis gasoline feedstock. This is required because the high temperature hydrotreating condition that is often required for sulfur removal also tends to cause the dienes and olefins of the pyrolysis gasoline to form polymers. These polymers can cause fouling of the process system by being deposited upon the equipment and catalyst surfaces. There is no suggestion in the prior art of a process for the hydrotreatment of pyrolysis gasoline in a single reactor stage to selectively remove by hydrogenation the organic sulfur, diolefin, and mono-olefin compounds over aromatic compounds contained in the pyrolysis gasoline.

It can be desirable to have a process for the hydrotreating of a pyrolysis gasoline feedstock to remove sulfur compounds and hydrogenate diolefins to desirable concentration levels by using a single reactor stage instead of two reactor stages. It also can be desirable for such a single stage hydrotreating process to provide for the selective hydrogenation of both dienes and monoolefins to their corresponding alkanes but without a corresponding significant amount of aromatics hydrogenation.

Thus, the inventive process provides for the selective hydrogenation of diolefins and sulfur compounds that are contained in a pyrolysis gasoline feedstock having a diolefin concentration and an organic sulfur concentration. In this process, a hydrocarbon stream that comprises the pyrolysis gasoline is introduced into a reactor that is loaded with a high activity hydrotreating catalyst and operated at selective hydrogenation conditions, wherein the pyrolysis gasoline feedstock is contacted with the high activity hydrotreating catalyst. A reactor effluent having a reduced diolefin concentration and a reduced organic sulfur concentration is yielded from the reactor. The reactor effluent is separated into a portion of the reactor effluent and a remaining portion of the reactor effluent with the portion of the reactor effluent being introduced as a recycle into the reactor.

Another of the inventive processes provides for the selective hydrogenation of monoolefins, diolefins, and sulfur compounds that are contained in a pyrolysis gasoline feedstock that includes a monoolefins concentration, a diolefins concentration, an aromatics concentration, and an organic sulfur concentration. In this process, a hydrocarbon stream that comprises the pyrolysis gasoline feedstock is introduced into a reactor that is loaded with a high activity hydrotreating catalyst and operated under selective hydrogenation conditions and in which the hydrocarbon stream is contacted with the high activity hydrotreating catalyst. A reactor effluent having a reduced monoolefin concentration, a reduced diolefin concentration, a reduced organic sulfur concentration, and an aromatics content of at least 90 wt % of a reactor inlet aromatics content is yielded from a reactor outlet of the reactor.

Figure 1:
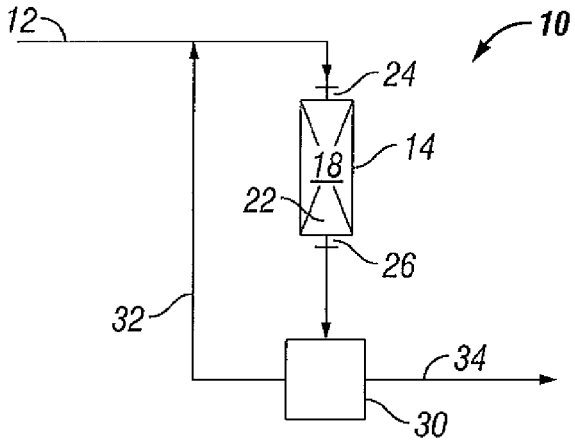
FIG. 1 is a simplified schematic representation of a generalized process flow of an embodiment of the inventive process.

The inventive process provides for the treatment of a pyrolysis gasoline feedstock that has undesirably high concentrations of organic sulfur compounds, diolefins (dienes), and, depending upon the desired use of the pyrolysis gasoline feedstock, mono-olefins. Unlike typical prior art pyrolysis gasoline hydrotreating processes, the inventive process utilizes a single reaction stage to both remove the organic sulfur and hydrogenate the dienes but without the significant formation of polymers or gums that can cause system fouling or without the significant hydrogenation of the aromatics contained in the pyrolysis gasoline feedstock. In a preferred embodiment, the process uses a single reaction stage to selectively remove from a pyrolysis gasoline feedstock, by hydrogenation, organic sulfur, diolefin and mono-olefin compounds with a minor amount of saturation of the aromatic compounds contained in the pyrolysis gasoline feedstock.

Many typical prior art pyrolysis gasoline hydrotreating processes use two separate reaction stages with the first reaction stage being operated under relatively low severity reaction conditions to hydrogenate the diolefins and alkenyl aromatics of the pyrolysis gasoline feedstock to there corresponding monoolefin and branched aromatic compounds and with the second reaction stage being operated under conditions so as to avoid or minimize the saturation of aromatics while providing for desulfurization, and, optionally, monoolefin hydrogenation. In these processes, the first reaction stage will use a noble metal catalyst or a partially sulfided nickel catalyst and the second reaction stage will use a limited activity nickel-molybdenum or cobalt-molybdenum catalyst.

Those skilled in the art of pyrolysis gasoline hydrotreating have traditionally considered it unfeasible to directly hydrodesulfurize a pyrolysis gasoline feedstock in a first reaction stage because of the high concentrations of highly reactive constituents, such as, for example, diolefins, monoolefins, styrene, and alkenyl aromatics, that are contained in the pyrolysis gasoline feedstock and which tend to polymerize under the more severe reaction conditions required for hydrodesulfurization. Thus, in the prior art, pyrolysis gasoline hydrotreating is generally done with the two-stage process wherein the reactive diolefins and alkenyl aromatics are first hydrogenated in the first reactor stage followed by hydrodesulfurization and olefin saturation done in the second reactor stage. The inventive process, however, provides for the selective hydrotreating of a pyrolysis gasoline feedstock that is conducted by employing a single reaction stage in a manner that minimizes the polymerization of the highly reactive constituents and the saturation of aromatics of the pyrolysis gasoline feedstock.

The pyrolysis gasoline feedstock is a normally liquid byproduct of a thermal or steam cracking process for making lower olefins by the thermal cracking of a hydrocarbon feed source, for example, ethane, propane, naphtha, gas oil or a combination thereof. The components of the pyrolysis gasoline normally have boiling temperatures (at atmospheric pressure) in the gasoline boiling range, which can be in the range of from 10° C. (50° F.) to 215° C. (419° F.). The components of the pyrolysis gasoline are those hydrocarbons that have from 4 to 11 carbon atoms per molecule, but may also include hydrocarbons that have greater than 11 carbon atoms per molecule, and include olefins, which include monoolefins, diolefins and alkyl aromatics, paraffins, cycloalkanes, and aromatics. The pyrolysis gasoline also comprises organic sulfur compounds, which can include thiophene compounds, mercaptan compounds, thiol compounds, benzothiophene compounds, and/or other organic sulfur compounds, including organic sulfide and disulfide compounds.

The pyrolysis gasoline has a significant aromatics content. The aromatic compounds of the pyrolysis gasoline can be those selected from the group consisting of benzene, toluene, $C_8$ compounds (xylenes, ethylbenzene, and styrene), $C_9$ aromatic compounds, and any combination of two or more thereof. Among the aromatics, those that are predominantly present are benzene and toluene with the $C_8$ aromatics and $C_9$ aromatics typically being present at relatively minor concentrations. The aromatics content of the pyrolysis gasoline can be in the range of from 10 wt % to 80 wt % of the total stream. More typically, the aromatics content is in the range of from 20 wt % to 70 wt %, and, most typically, from 30 wt % to 60 wt %.

The organic sulfur concentration or content of the pyrolysis gasoline feedstock, typically exceeds 50 ppmw, but is generally in the range of from 0.01 wt % (100 ppmw) to 1.5 wt % (15,000 ppmw). More typically, the organic sulfur content is in the range of from 0.025 wt % (250 ppmw) to 1.0 wt % (10,000 ppmw), and, most typically, it is from 500 ppmw to 5,000 ppmw.

The diolefin or diene content of the pyrolysis gasoline feedstock, typically, exceeds 3 wt % and can be in the range of from 3 wt % to 30 wt %, more typically, from 4 to 25 wt %, and, most typically, from 5 to 20 wt %.

The concentration of monoolefins present in the pyrolysis gasoline feedstock is in the range of from 1 to 20 wt %, more typically, from 1 to 15 wt %, and, most typically, from 2 to 12 wt %.

The paraffins and cycloalkanes of the pyrolysis gasoline feedstock can be in the range upwardly to 20 wt %, but, more typically, the paraffins content is in the range of from 1 to 20 wt %.

In the inventive process, a hydrocarbon stream that comprises a pyrolysis gasoline feedstock, having the properties as defined above, and hydrogen are charged or introduced into a reactor that contains a high activity hydrotreating catalyst. The reactor is operated at selective hydrogenation conditions. The hydrocarbon stream and hydrogen are together contacted with the high activity hydrotreating catalyst within the reactor.

The reactor of the process may be any means or apparatus, such as a vessel, that defines at least one selective hydrogenation reaction zone in which is contained a volume of high activity hydrotreating catalyst and that provides for the contacting of the pyrolysis gasoline feedstock in the presence of hydrogen and under selective hydrogenation reaction conditions with the high activity hydrotreating catalyst.

Generally, the reactor is a vessel that defines a selective hydrogenation reaction zone and is equipped with a reactor inlet (feed inlet) providing means for receiving into the vessel the pyrolysis gasoline feedstock as an inlet feed and a reactor outlet providing means for withdrawing from the vessel a reactor effluent.

The pyrolysis gasoline feedstock, or hydrocarbon stream that comprises the pyrolysis gasoline feedstock, that is introduced into the selective hydrogenation reaction zone of the reactor has a diolefin concentration, a monoolefin concentration, an organic sulfur concentration and an aromatics content, all as described in detail above. The pyrolysis gasoline feedstock is introduced into the reactor at a reactor inlet temperature required for the selective hydrogenation reaction conditions.

It is a significant feature of the inventive process that the selective hydrogenation reaction conditions of the inventive process are relatively mild as compared to the conditions of other typical desulfurization hydrotreating processes. These milder reaction conditions result in the occurrence of less polymerization of the highly reactive constituents of the pryolysis gasoline stream. The use of the high activity hydrotreating catalyst, recycling of all or selected fractions of the treated reactor effluent, and other features of the inventive process allow for the single stage selective hydrogenation and hydrodesulfurization of the pyrolysis gasoline feedstock with a minimal amount of aromatics saturation and polymer formation.

Thus, the feed inlet temperature of the process should be in the range of from 100° C. (212° F.) to 260° C. (500° F.), and, preferably, it is in the range of from 120° C. (248° F.) to 250° C. (482° F.). Most preferably, the feed inlet temperature should be in the range of from 150° C. (302° F.) to 240° C. (464° F.).

The reactor operating pressure (the average of the reactor inlet pressure and reactor outlet pressure) is in the range of from 10 bara to 100 bara, or from 15 bara to 70 bara, or from 20 bara to 60 bara.

The feed rate of the pyrolysis gasoline feedstock to the reactor should be such that the weight hourly space velocity (i.e., mass flow rate of pyrolysis gasoline feedstock, excluding recycle, charged to the reactor per hour divided by the catalyst mass contained in the reactor) is in the range of from 0.2 to 40 $hr^{-1}$, or from 0.5 to 30 $hr^{-1}$, or from 1 to 20 $hr^{-1}$.

The amount of hydrogen charged to the reactor with the pyrolysis gasoline feedstock may be such as to provide a hydrogen treat rate in the range upwardly to about 50,000 moles of hydrogen per cubic meter of pyrolysis gasoline feedstock ($mol/m^3$). It is desirable for the hydrogen treat rate to be in the range of from 100 $mol/m^3$ to 50,000 $mol/m^3$. More typically, the hydrogen treat rate is in the range of from 500 $mol/m^3$ to 25,000 $mol/m^3$.

The reactor effluent yielded from the reactor has both a reduced diolefin concentration relative to the diolefin concentration of the pyrolysis gasoline feedstock and a reduced organic sulfur concentration relative to the organic sulfur concentration of the pyrolysis gasoline feedstock. The reduced diolefin concentration should be less than 10 ppmw of the reactor effluent (excluding the hydrogen), and, preferably, it is less than 5 ppmw. Most preferably, the reactor effluent has a reduced diolefin concentration of less than 1 ppmw. The reduced organic sulfur concentration of the reactor effluent should be less than 3 ppmw (based on the reactor effluent excluding the hydrogen), and, more preferably, it is less than 2 ppmw. Most preferably, the reactor effluent has a reduced organic sulfur concentration of less than 1 ppmw or even more preferably a reduced organic sulfur concentration of less than 0.5 ppmw.

In a preferred embodiment of the inventive process, the selective hydrogenation can also include saturation of a substantial portion of the monoolefins contained in the pyrolysis gasoline feedstock and, thus, the reactor effluent will have a reduced monoolefin concentration relative to the monoolefin concentration of the pyrolysis gasoline feedstock. The monoolefin concentration of the reactor effluent can be measured by determining the bromine number of the stream, which is defined as the amount of bromine in grams absorbed by 100 grams of a sample. The bromine number of the reactor effluent is preferably less than 1, more preferably less than 0.4 and most preferably less than 0.2. The bromine number may be in a range of from 0.05 to 0.4 or in a range of from 0.1 to 0.2.

As previously noted, a particularly significant feature of the inventive process is that it is capable of providing for the combined conversion removal of organic sulfur, diolefins and monoolefins of the pyrolysis gasoline feedstock in a single reaction stage without an excessive amount of saturation (hydrogenation) of the aromatics contained in the pyrolysis gasoline feedstock. Thus, in general, the reactor outlet aromatics content (i.e., the amount of aromatics contained in the reactor effluent) should be at least 90 wt % of a reactor inlet aromatics content. The reactor inlet aromatics content is defined as being the amount of aromatics contained in the total feed charged to the reactor. The total feed charged to the reactor may include only pyrolysis gasoline feedstock, or pyrolysis gasoline feedstock with a hydrocarbon diluent, or a combination of one or both of the aforementioned with a recycle stream. Because the process is particularly selective in its hydrogenation conversion of the olefins and sulfur compounds of the pyrolysis gasoline feedstock the reactor outlet aromatics content can be at least 95 mole % of the reactor inlet aromatics content. Preferably, the reactor outlet aromatics content is at least 97 mole % of the reactor inlet aromatics content, and, more preferably, the reactor outlet aromatics content is at least 98 mole % of the reactor inlet aromatics content.

An important aspect of one of the embodiments of the inventive process is for there to be a recycle of a portion of the reactor effluent as feed along with the pyrolysis gasoline feedstock to the reactor. The ratio of recycle-to-pyrolysis gasoline feedstock introduced into the reactor should be sufficiently high to provide for the required benefits of the inventive process. In this embodiment of the inventive process, the reactor effluent is separated into a portion of the reactor effluent and a remaining portion of the reactor effluent. As these terms are used herein, the portion of the reactor effluent that is used as a recycle may be either a fraction of the entire or total reactor effluent that is withdrawn from the reactor and which includes not only the normally liquid hydrocarbons but also the gaseous hydrocarbons and hydrogen that are included in the total reactor effluent, or it may be a fraction of a liquid fraction obtained by one or more phase separations of the reactor effluent withdrawn from the reactor, or it may be a fraction of one or more of the distillation cuts of the liquid fraction obtained by the aforementioned one or more phase separations, or the recycle may be any combination of the aforementioned reactor effluent streams.

The weight ratio of recycle-to-pyrolysis gasoline feedstock introduced into the reactor should be greater than 1:1. Because large operating costs and diminished benefits result from excessively high recycle rates, it is generally desirable to have an upper limit on the recycle ratio. Thus, the weight ratio of recycle-to-pyrolysis gasoline feedstock of the process should be within the range of from 1:1 to 25:1. A preferred range for the weight ratio of recycle-to-pyrolysis gasoline feedstock is of from 2:1 to 20:1, more preferred, from 3:1 to 15:1, and, most preferred, from 3:1 to 10:1. It is understood that the recycle ratio of recycle-to-pyrolysis gasoline feedstock, as the term is used herein, is calculated in respect to the fresh pyrolysis gasoline feedstock that is actually charged to the reactor, excluding any diluents that may accompany the pyrolysis gasoline feedstock, such as the recycle stream itself.

The high activity hydrotreating catalyst that is loaded into the reactor of the inventive process is contained within and forms a part of the reaction zone defined by the reactor. The high activity hydrotreating catalyst used in the process can be any suitable catalyst composition that provides for the selective hydrogenation of diolefins, monoolefins, and sulfur compounds of the pyrolysis gasoline feedstock under the selective hydrogenation conditions as described herein.

One particularly desirable high activity hydrotreating catalyst for use in the inventive process comprises a molybdenum component and either a nickel component or a cobalt component, or both nickel and cobalt components, supported upon a porous refractory oxide. Typically, the molybdenum component can be present in the high activity hydrotreating catalyst in an oxide form, e.g. $MoO_3$, at a concentration that is in the range of from 3 wt. % to 30 wt. %, based on the total weight of the high activity hydrotreating catalyst and assuming the molybdenum is present in the oxide form as $MoO_3$. The nickel component or the cobalt component can be present in the high activity hydrotreating catalyst in an oxide form, e.g. NiO or CoO, at a concentration that is in the range of from 1 wt. % to 10 wt. %, based on the total weight of the high activity hydrotreating catalyst and assuming the nickel is present in the oxide form as NiO or, if cobalt is present, assuming the cobalt is present in the oxide form as CoO. If both the nickel component and the cobalt component are present in the high activity hydrotreating catalyst, then the total amount of the nickel component and the cobalt component is in the range of from 1 wt. % to 10 wt. %, based on the total weight of the high activity catalyst.

The active metal or metals of the high activity hydrotreating catalyst are supported on a porous refractory oxide support. It is preferred for the support of the high activity hydrotreating catalyst to be prepared by shaping or forming of a support material (typically a porous refractory oxide selected from the group consisting of aluminum oxide, silicon oxide, titanium oxide, zirconium oxide, and combinations of two or more thereof) into an agglomerate, such as, an extrudate, a tablet, a ball, or any other agglomerated mass, which may or may not be calcined. The support is then impregnated with an impregnation solution containing the required amount of active metal component, i.e., the molybdenum and nickel, or molybdenum and cobalt, or molybdenum, nickel and cobalt.

The support may include an underbedded nickel component, and, if present, the underbedded nickel concentration in the support can be in the range upwardly to 3 wt % of the total weight of the support assuming the nickel is present in the support as an oxide. If the support has an underbedded nickel component, typically, it is present at a concentration in the range of from 0.1 wt % to 2 wt % of the total weight of the support.

Examples of suitable catalyst compositions for use as the high activity hydrotreating catalyst of the inventive process are described in detail in U.S. patent application Ser. No. 12/397,980, filed 4 Mar. 2009, and U.S. patent application Ser. No. 12/398,009, filed 4 Mar. 2009. The disclosures of these patent applications are incorporated herein by reference. Particularly desirable catalyst compositions for use as the high activity hydrotreating catalyst of the inventive process are described in detail in U.S. patent application Ser. No. 12/185,209, filed 4 Aug. 2008, published as US 2009/0038993 on 12 Feb. 2009, and U.S. patent application Ser. No. 12/407,479, filed 19 Mar. 2009, both of such disclosures are incorporated herein by reference. The most preferred catalyst compositions for use as the high activity hydrotreating catalyst are those described in the aforementioned U.S. patent application Ser. No. 12/407,479.

Presented in FIG. 1 is a simplified schematic representation of the generalized flow of the inventive process 10 for the selective hydrogenation of diolefins and sulfur compounds contained in a pyrolysis gasoline feedstock.

In process 10, the pyrolysis gasoline feedstock is passed by way of conduit 12 and is fed to reactor 14. Reactor 14 may be any apparatus known to those skilled in the art, such as a vessel, that defines at least one selective hydrogenation reaction zone 18, which contains a high activity hydrotreating catalyst 22. Reactor 14 is equipped with reactor inlet 24 that provides means for receiving into reactor 14 the pyrolysis gasoline feedstock and with reactor outlet 26 that provides means for withdrawing a reactor effluent from reactor 14. Reactor 14 also provides means for contacting the pyrolysis gasoline feedstock with high activity hydrotreating catalyst 22 under suitable selective hydrogenation conditions.

A reactor effluent is yielded from reactor 14 and passes to separation system 30. Separation system 30 provides means for separation or splitting of the reactor effluent into a portion that can be recycled by way of conduit 32 and introduced as a feed into reactor 14 and a remaining portion that passes downstream by way of conduit 34 for further processing or handling (not shown).

Separation system 30 may include any means or method for the separation or splitting of the reactor effluent into two or more portions of the reactor effluent wherein at least one of the portions thereof may be used as a recycle feed to reactor 14. The separation means may include merely a split in a conduit or pipe along with the use of flow control valves, or it may include the use of one or more high or low pressure phase separators providing for one or more liquid fractions and vapor fractions with any one of the liquid or vapor fractions or portion thereof being used as a recycle feed to reactor 14, or it may include multiple separation steps by multiple means, for example, by phase separation or by fractionation, or by dividing or by any other suitable means.

Figure 2:
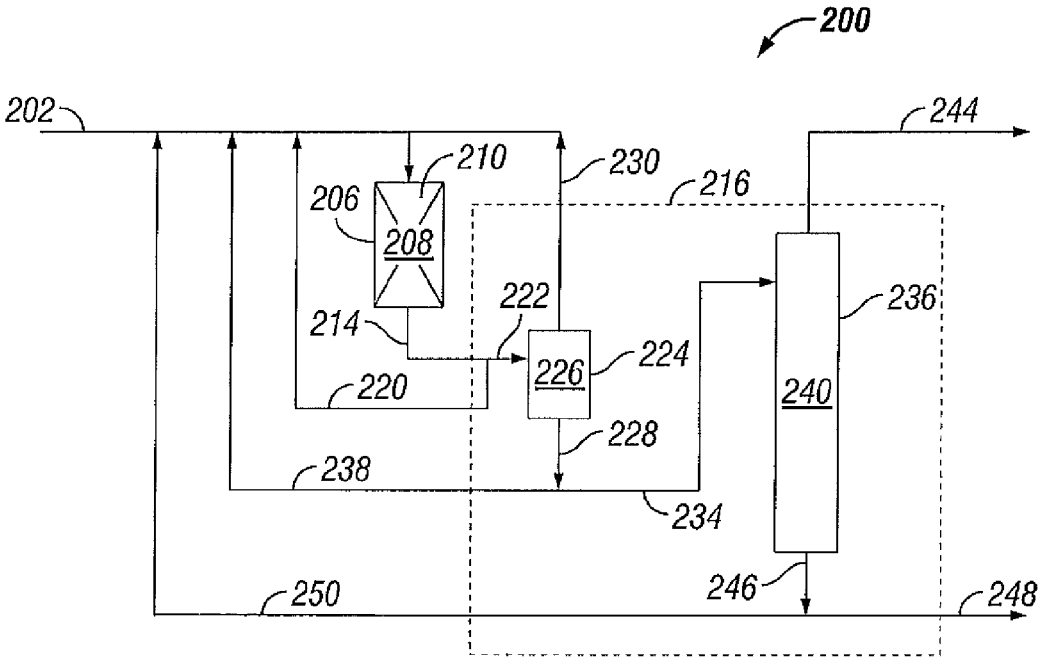
FIG. 2 is a schematic of a more specific process flow that includes several embodiments of the inventive process.

Presented in FIG. 2 is schematic representation of the flow of process unit 200 that includes certain features and embodiments of the inventive process.

In process unit 200, a pyrolysis gasoline feedstock, having a diolefin concentration and an organic sulfur concentration, is passed by way of conduit 202 to be introduced as a feed to reactor 206. Reactor 206 defines a selective hydrogenation reaction zone 208, which contains a high activity hydrotreating catalyst 210. Reactor 206 provides means for contacting the pyrolysis gasoline feedstock with high activity hydrotreating catalyst 210 under suitable selective hydrogenation conditions.

Yielded from reactor 206 is a reactor effluent, which has reduced diolefin, monoolefin, and organic sulfur content as compared to the diolefin, monoolefin and organic sulfur contents of the pyrolysis gasoline feedstock. The reactor effluent is withdrawn from reactor 206 and passes by way of conduit 214 to separation system 216. Separation system 216 provides for the separation of the reactor effluent into one or more portions of the reactor effluent that may be used as recycle streams to be fed to reactor 206 along with the pyrolysis gasoline feedstock and one or more remaining portions of the reactor effluent that are either recycled or passed downstream for further processing or handling.

In one embodiment of the invention presented in FIG. 2, the reactor effluent may be split into a total reactor effluent portion of the reactor effluent and a total reactor effluent remaining portion of the reactor effluent. The term "total reactor effluent" is used to indicate that it is the full or entire reactor effluent passing from reactor 206 that is separated or split into a recycle stream and a remaining stream without it first undergoing an intermediate separation step. The total reactor effluent portion (the word "total" is used in the sense that the portion of the reactor effluent that is being recycled is the full range of reactor effluent, including hydrogen and other normally gaseous components, without conducting a prior separation of certain of reactor effluent components therefrom) is then passed by way of conduit 220 to be used as a total recycle stream to be fed to reactor 206 along with the pyrolysis gasoline feedstock. It is understood, however, that it is not preferred to split the total reactor effluent without it first undergoing a separation into other components prior to recycling a portion thereof. The total reactor effluent remaining portion of the reactor effluent passes downstream by way of conduit 222 to phase separator 224. As for all the conduits of process unit 200, a heat exchanger (not shown) may be interposed in conduit 222 to remove heat, or add heat if necessary, from the reactor effluent prior to its introduction to phase separator 224.

Phase separator 224 defines a phase separation zone 226 and provides for separating the reactor effluent passing from reactor 206 by way of conduits 214 and 222 into a liquid fraction and a vapor fraction. The reactor effluent introduced into phase separator 224 may be the entire reactor effluent withdrawn from reactor 206 or any portion thereof, including, for example, the total reactor effluent remaining portion. The depicted phase separator 224 may also include two or more additional phase separators (separation stages) placed in series flow communication with each other. Intermediate cooling may further be used between each of the phase separation stages for cooling the separated vapor phases and to provide for further condensing of the components of the separated vapor phases.

The liquid fraction passes from phase separator 224 by way of conduit 228 and the vapor fraction passes from phase separator 224 by way of conduit 230. The vapor fraction comprises a significant proportion that is hydrogen, and, thus, it is useful as a hydrogen recycle to be introduced into reactor 206 as a feed along with the pyrolysis gasoline feedstock and other recycle stream(s) of process unit 200. The entire liquid fraction, or any portion thereof, is passed by way of conduit 234 to distillation fractionator 236.

In one embodiment of the inventive process, the liquid fraction is separated or split into a liquid fraction portion and a liquid fraction remaining portion. The liquid fraction portion passes by way of conduit 238 to be used as a first recycle stream and to be fed as a recycle to reactor 206 along with the pyrolysis gasoline feedstock. The liquid fraction remaining portion of the liquid fraction is fed to distillation fractionator 236 by way of conduit 234.

Distillation fractionator 236 defines a distillation separation zone 240 and provides means for separating the liquid fraction or liquid fraction remaining portion into a light cut and a heavy cut. The heavy cut comprises predominantly the hydrocarbon components of the liquid fraction having nine carbon atoms or more (C9+ compounds) and the light cut comprises predominantly the hydrocarbon components of the liquid fraction having eight carbon atoms or fewer (C8− compounds).

The light cut passes as an overhead stream from distillation fractionator 236 by way of conduit 244. The heavy cut passes as a bottoms stream from distillation fractionator 236 by way of conduit 246, and the entire heavy cut, or any portion thereof, passes downstream by way of conduit 248. The heavy cut may be split or separated into a heavy cut portion and a heavy cut remaining portion. The heavy cut portion of the heavy cut passes by way of conduit 250 to be used as a second recycle stream or heavy cut recycle stream to be fed as a recycle to reactor 206 along with the pyrolysis gasoline feedstock.

The following example is provided for the purpose only to illustrate the invention, and, thus, it should not be considered as limiting the scope of the claimed invention.

EXAMPLE

Calculated

This calculated example presents a summary of certain of the results generated by running a computer simulation model of one embodiment of the inventive process.

For this simulation, the process includes a single reactor stage with a hot high-pressure separator (phase separator) for receiving the reactor effluent from the reactor and separating the reactor effluent into a liquid fraction and a vapor fraction. Prior to introducing the reactor effluent into the hot high-pressure separator, the reactor effluent exchanges heat by indirect heat exchange (e.g., by the use of a shell-tube heat exchanger) with the incoming pyrolysis gasoline feedstock to be introduced into the reactor. The vapor fraction from the hot high-pressure separator is cooled by, for example, air cooled heat exchanger, such as a fin fan exchanger, and then passed to and introduced into a cool high-pressure separator for separating the cooled vapor fraction into a second vapor fraction and a second liquid fraction. The second vapor fraction comprises a significant proportion thereof that is hydrogen and is recycled as a feed to the reactor.

The process utilizes a significantly high recycle ratio with the preferred recycle stream being the liquid fraction from the hot high-pressure separator. Thus, a portion of the liquid fraction is recycled as a feed to the reactor and a remaining portion of the liquid fraction is passed to and introduced into a fractionator. The fractionator provides for the distillation separation of the second liquid fraction and the remaining portion of the liquid fraction that is not recycled to the reactor into a heavy C9+ cut and a light C8− cut.

Presented in Table 1 are the operating conditions and other features for single reactor stage process described in this example.

TABLE 1

| Reactor Details and Operating Conditions | |
|---|---|
| Reactor Type | Trickle Phase |
| Fresh Feed Rate | 79.7 metric tons/hr |
| Total Catalyst Volume (Mass) | 56.8 $m^3$ (42,570 kg) |
| Inlet Pressure | 32 bara |
| Recycle Ratio (liquid fraction/fresh feed) | 8 |
| $H_2$ Consumption | 11,755 $Sm^3$/hr |
| Inlet Temperature | 180° C. |
| Outlet Temperature | 210° C. |
| Inlet Sulfur | 500 ppm |
| Product Sulfur | 0.08 ppm |

Presented in the following Table 2 are compositions, excluding the hydrogen content, of the pyrolysis gasoline feedstock to the single reactor stage process and the reactor effluent (at the reactor outlet).

TABLE 2

Composition of Fresh Feed and Reactor Effluent (X-hydrogen)

| | Fresh Feed (wt %) | Reactor Outlet (wt %) |
|---|---|---|
| Sulfur | 500 ppm | 0 ppm |
| C4 Diolefins | 0.64 | 0.00 |
| C4 Olefins | 0.27 | 0.00 |
| C4 Paraffins | 0.50 | 1.44 |
| Isoprene | 3.41 | 0.00 |
| 2MB2 | 0.86 | 0.08 |
| i-Pentane | 4.91 | 9.19 |
| Cy-Pentdienes | 4.02 | 0.00 |
| Cy-Pentenes | 0.83 | 0.00 |
| Cy-Pentane | 1.04 | 6.07 |
| C5 Diolefins | 1.62 | 0.00 |
| C5 Olefins | 2.96 | 0.00 |
| C5 Paraffins | 8.03 | 12.63 |
| C6 Diolefins | 3.4 | 0.00 |
| C6 Olefins | 0.88 | 0.00 |
| C6 Paraffins | 5.64 | 9.98 |
| Benzene | 30.64 | 28.99 |
| Cy-Hexane | 0.36 | 1.69 |
| C7 Diolefins | 0.00 | 0.00 |
| C7 Olefins | 0.08 | 0.00 |
| C7 Paraffins | 0.94 | 1.01 |
| Toluene | 12.89 | 12.00 |
| MCH | 0.18 | 0.94 |
| Styrene | 3.35 | 0.00 |
| Ethyl Benzene | 1.38 | 4.46 |
| C8 Aromatics | 1.76 | 1.66 |
| C8 Naphthenes | 0.12 | 0.48 |
| C8 Paraffins | 0.26 | 0.25 |
| Indenes | 1.14 | 0.00 |
| Indane | 0.10 | 1.17 |
| C9 Alkenyl Aromatics | 1.29 | 0.00 |
| C9 Aromatics | 0.87 | 2.03 |
| C9 Naphthenes | 0.01 | 0.21 |
| DCPD | 4.03 | 0.00 |
| di-hyd-DCPD | 0.01 | 0.00 |
| C10 Naphthenes | 1.27 | 5.35 |
| C11 Heavies | 0.36 | 0.35 |
| Total | 100.00 | 100.00 |

What is claimed is:

1. A process for the selective hydrogenation of diolefins and sulphur compounds contained in a pyrolysis gasoline feedstock, comprising a diolefin concentration exceeding 3 wt % and an organic sulfur concentration exceeding 50 ppmw, wherein said process comprises:

introducing a hydrocarbon stream that comprises said pyrolysis gasoline feedstock into a reactor that contains a single hydrotreating reaction stage comprising hydrotreating catalyst and operated at selective hydrogenation conditions, wherein said hydrocarbon stream is contacted with said hydrotreating catalyst;

yielding from said reactor a reactor effluent comprising a reduced diolefin concentration of less than 10 ppmw, a reduced organic sulfur concentration of less than 3 ppmw, and an aromatics content of at least 90 wt % of a reactor inlet aromatics content;

separating said reactor effluent into a portion of said reactor effluent and a remaining portion of said reactor effluent;

and introducing as a recycle said portion of said reactor effluent into said reactor wherein the weight ratio of said recycle to said hydrocarbon stream is greater than 1:1.

2. A process as recited in claim 1, wherein said selective hydrogenation conditions include a feed inlet temperature to said reactor that is in the range of from 100° C. to 250° C., a reactor operating pressure in the range of from 10 bara to 100 bara, and a weight hourly space velocity in the range of from 0.2 to 40 $hr^{-1}$.

3. A process as recited in claim 2, wherein said pyrolysis gasoline feedstock further comprises monoolefins at a concentration in the range of from 1 to 20 wt % and aromatics at a concentration in the range of from 10 wt % to 80 wt %, and wherein said reactor effluent has a reduced monoolefin concentration as measured by a bromine number of less than 1 and aromatics content of at least 95 wt % of said hydrocarbon stream.

4. A process as recited in claim 2, wherein said hydrotreating catalyst comprises molybdenum and either nickel or cobalt supported on alumina.

5. A process as recited in claim 4, wherein said step of separating said reactor effluent includes:

separating said reactor effluent into a total reactor effluent portion of said reactor effluent and a total reactor effluent remaining portion of said reactor effluent; and using said total reactor effluent portion as a total recycle stream of said recycle.

6. A process as recited in claim 4, wherein said step of separating said reactor effluent includes:

passing said reactor effluent to a separator for separating said reactor effluent into a liquid fraction and a vapor fraction;

passing said liquid fraction to a fractionator for separating said liquid fraction into a light cut and a heavy cut;

separating said heavy cut into a heavy cut portion of said heavy cut and a heavy cut remaining portion of said heavy cut; and using said heavy cut portion of said heavy cut as a heavy cut recycle stream of said recycle.

7. A process as recited in claim 4, wherein said step of separating said reactor effluent includes:

passing said reactor effluent to a separator for separating said reactor effluent into a liquid fraction and a vapor fraction;

separating said liquid fraction into a liquid fraction portion of said liquid fraction and a liquid fraction remaining portion of said liquid fraction; and using said liquid fraction portion of said liquid fraction as a first recycle stream of said recycle.

8. A process as recited in claim 7, wherein said step of separating said reactor effluent further includes:

passing said liquid fraction remaining portion of said liquid fraction to a fractionater for separating said liquid fraction remaining portion of said liquid fraction into a light cut and a heavy cut;

separating said heavy cut into a heavy cut portion of said heavy cut and a heavy cut remaining portion of said heavy cut; and using said heavy cut portion of said heavy cut as a second recycle stream of said recycle.

9. A process as recited in claim 6, further comprising:

introducing said vapor fraction into said reactor along with said hydrocarbon stream and said recycle.

10. A process for the selective hydrogenation of monoolefins, diolefins, and sulfur compounds contained in a pyrolysis gasoline feedstock, wherein said pyrolysis gasoline feedstock having a monoolefins concentration, a diolefins concentration, an aromatics concentration, and an organic sulfur concentration, and wherein said process comprises:

introducing a hydrocarbon stream that comprises said pyrolysis gasoline feedstock into a reactor that contains a single hydrotreating reaction stage comprising hydrotreating catalyst and operated under selective hydrogenation conditions, wherein said hydrocarbon stream is contacted with said hydrotreating catalyst;

yielding from a reactor outlet of said reactor a reactor effluent having a reduced monoolefin concentration, a reduced diolefin concentration, a reduced organic sulfur concentration, and an aromatics content of at least 90 wt % of a reactor inlet aromatics content; and introducing as a recycle a portion of said reactor effluent into said reactor wherein the weight ratio of said recycle to said hydrocarbon stream is greater than 1:1.

11. A process as recited in claim 10, wherein said monoolefins concentration is in the range of from 1 to 20 wt %, said diolefins concentration exceeds 3 wt %, said aromatics concentration is in the range of from 10 wt % to 80 wt %, and said organic sulphur concentration exceeds 50 ppmw, and wherein said reduced monoolefin concentration is measured by a bromine number of less than 1, said reduced diolefin concentration is less than 10 ppmw, and said reduced organic sulfur concentration is less than 3 ppmw.

12. A process as recited in claim 11, further comprising:

introducing into said reactor with said hydrocarbon stream a portion of said reactor effluent as a recycle at a rate so as to provide a weight ratio recycle-to-hydrocarbon stream that is greater than 1:1.

13. A process as recited in claim 12, wherein said selective hydrogenation conditions include a feed inlet temperature to said reactor that is in the range of from 100° C. to 250° C., a reactor operating pressure in the range of from 10 bara to 100 bara, and a weight hourly space velocity in the range of from 0.2 to 40 $hr^{-1}$.

14. A process as recited in claim 13, wherein said hydrotreating catalyst comprises molybdenum and either nickel or cobalt supported on alumina.

* * * * *